US006688111B2

(12) United States Patent
Stalder et al.

(10) Patent No.: US 6,688,111 B2
(45) Date of Patent: Feb. 10, 2004

(54) METHOD FOR OPERATING A COMBUSTION CHAMBER

(75) Inventors: Marcel Stalder, Klingnau (CH); Daniel Burri, Rothenburg (CH); Urs Benz, Gipf-Oberfrick (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 09/987,117

(22) Filed: Nov. 13, 2001

(65) Prior Publication Data

US 2003/0093997 A1 May 22, 2003

(30) Foreign Application Priority Data

Nov. 14, 2000 (DE) ..... 100 56 243

(51) Int. Cl.[7] ..... F02C 3/14

(52) U.S. Cl. ..... 60/776; 60/737; 60/39.17; 431/5; 431/9

(58) Field of Search ..... 60/737, 776, 39.17, 60/804, 742, 748; 431/5, 9

(56) References Cited

U.S. PATENT DOCUMENTS

| | | | | | |
|---|---|---|---|---|---|
| 4,420,929 | A | * | 12/1983 | Jorgensen et al. | 60/776 |
| 5,097,666 | A | * | 3/1992 | Shekleton et al. | 60/737 |
| 5,109,671 | A | * | 5/1992 | Haasis | 60/804 |
| 5,431,018 | A | | 7/1995 | Keller | |
| 5,454,220 | A | * | 10/1995 | Althaus et al. | 60/774 |
| 5,593,302 | A | * | 1/1997 | Althaus et al. | 60/737 |
| 5,615,555 | A | * | 4/1997 | Mina | 60/748 |
| 5,626,017 | A | * | 5/1997 | Sattelmayer | 60/737 |
| 5,685,705 | A | * | 11/1997 | Knopfel | 431/9 |
| 5,850,732 | A | * | 12/1998 | Willis et al. | 60/804 |
| 6,038,848 | A | * | 3/2000 | Frutschi | 60/775 |

FOREIGN PATENT DOCUMENTS

| | | |
|---|---|---|
| DE | 43 16 474 A1 | 11/1994 |
| DE | 44 17 538 A1 | 11/1995 |
| DE | 195 10 743 A1 | 9/1996 |
| DE | 195 27 453 A1 | 1/1997 |
| DE | 198 59 829 A1 | 6/2000 |
| EP | 0 358 437 A1 | 3/1990 |
| EP | 0 687 860 A2 | 12/1995 |
| EP | 0 919 768 A1 | 6/1999 |
| EP | 1 030 109 A1 | 8/2000 |
| GB | 2 012 415 A | 7/1979 |
| WO | WO 98/42968 | 10/1998 |

* cited by examiner

*Primary Examiner*—Ted Kim
(74) *Attorney, Agent, or Firm*—Burns, Doane, Swecker & Mathis, L.L.P.

(57) ABSTRACT

A combustion chamber includes a mixing zone and a combustion zone within which self-ignition of a fuel and air mixture can occur. Fuel and support air are injected laterally at the sidewall of the mixing zone into hot gases passing through the mixing zone. The operating range of the combustion chamber can be increased while noxious substances are reduced by injecting differently controlled fuel/support air mixture jets into different target spaces within the mixing zone.

6 Claims, 1 Drawing Sheet

METHOD FOR OPERATING A COMBUSTION CHAMBER

FIELD OF THE INVENTION

The invention relates to a method of operating a combustion chamber where fuel and support air are injected into a hot gas flow within a mixing zone of the combustion chamber using at least one fuel lance.

BACKGROUND OF THE INVENTION

Unexamined patent application DE-A1-44 17 538 discloses a combustion chamber with self-ignition. In this combustion chamber, fuel and support air are introduced by a fuel lance into a hot gas flow, are mixed there, and the mixture is burned in a subsequent combustion zone. The fuel lance is centrally positioned in a mixing zone. The dimensions of the fuel lance are designed for approximately 10% of the total volume flow through the channel defining the mixing zone. The fuel can be injected from the centrally positioned fuel lance in a transverse direction or in the direction towards the flow. The injected fuel is carried by the vortices injected upstream along with a portion of support air over several radial openings and is mixed with the main flow. The injected fuel follows the helical course of the vortices and is evenly distributed downstream in the chamber. This reduces the risk of impacted jets on the opposing channel wall as well as the formation of "hot spots," as is the case in a flow without vortices.

The advantages of the central fuel injection are gained, however, at the cost of a fuel lance surface positioned in the hot gas flow that is relatively difficult to cool. This built-in element also has a substantial effect on the flow of the hot gases. For fluid flow reasons, a minimal lance length is required. This lance length furthermore requires that the fuel lance be inserted through a corresponding long hole into the burner for assembly. This creates a relatively large gap between the burner wall and fuel lance, which is relatively hard to seal. Accordingly irregular air leakages have a negative influence on the overall behavior of the burner.

SUMMARY OF THE INVENTION

In view of the above disadvantages of the prior art, the invention provides a combustion chamber and a method of operating the combustion chamber that make it possible to minimize the interference with the hot gas flow in the mixing zone of the combustion chamber. This should be accomplished along with simultaneously less cooling of the fuel lance, and an improved behavior of the combustion chamber in all load ranges should be achieved.

According to an embodiment of the invention, the fuel is injected from at least one side wall of the mixing zone of the combustion chamber. A combustion chamber according to an embodiment of the invention includes at least one fuel lance set into a side wall of the mixing zone of the combustion chamber. If desired, support air can also injected through this fuel lance.

One advantage of such a lateral, asymmetrical injection of the fuel is that the fuel lance causes only a slight interference with the flow since it is located only on the side wall of the mixing zone, and no longer centrally in the main flow. It is also advantageous if the at least one fuel lance is set into the side wall of the combustion chamber in the shape of a sphere or ellipsoid extending in the main flow direction and projecting into the interior of the mixing zone. By constructing the mixing zone as a Venturi channel or possibly additionally present built-in elements (radially or circumferentially), an increase in velocity and thus improved mixing of hot gas and fuel/support gas can be achieved. This type of arrangement practically excludes any follower areas behind the fuel lance in which fuel is able to collect.

The cooling of the fuel lance can be advantageously minimized with a reduced contact surface area between the fuel lance and the hot gas flow. The area of a seal between the sidewall of the mixing zone and the fuel lance is also kept advantageously small and in an advantageous shape.

According to a preferred embodiment of the method according to the invention, the fuel and, if desired, support air are injected in different fuel/support air mixture jets into the mixing zone of the combustion chamber. The different fuel/support air mixture jets are oriented in different directions or different sectors within the mixing zone of the combustion chamber. This embodiment is particularly advantageous because, depending on the load on the combustion chamber, jets can be added or switched off. This is also advantageous in combination with the above-mentioned built-in elements since with the targeted feeding of different sectors through the jets the fuel can be transported with the same pressure into different areas within the mixing zone.

BRIEF DESCRIPTION OF THE DRAWINGS

The invention is explained in more detail in reference to the enclosed figures, wherein only those elements essential to the invention are shown. Identical elements in different figures are designated in the same manner.

DETAILED DESCRIPTION OF THE PREFERRED EMBODIMENTS

Figure 1:
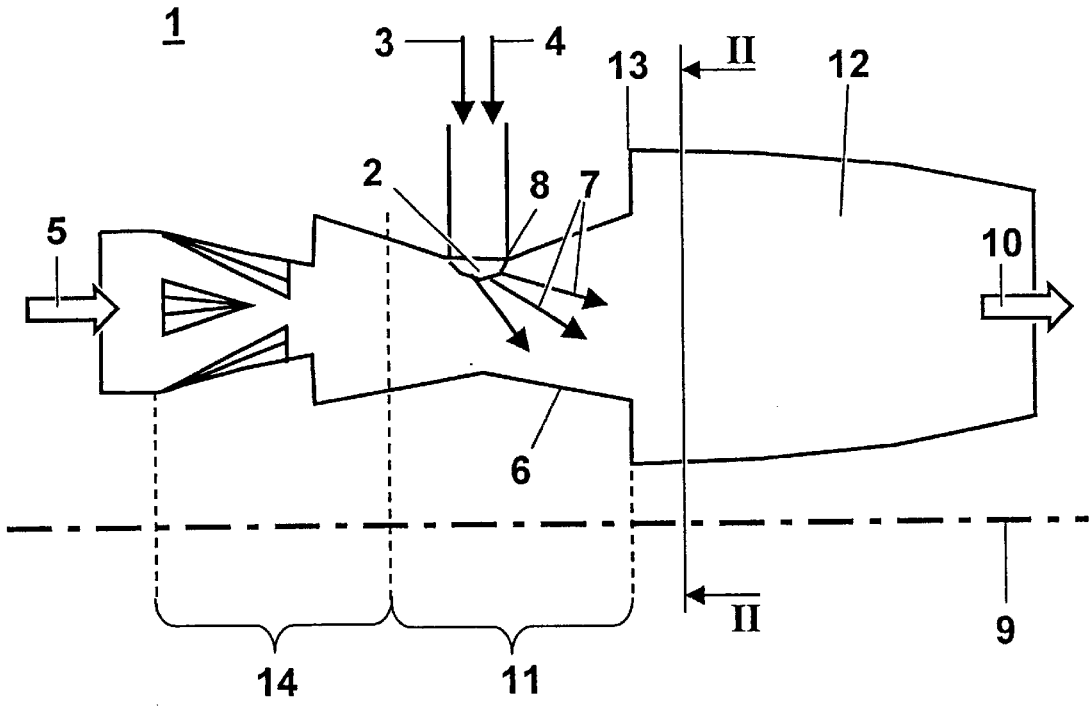
FIG. 1 schematically shows a section through an annular combustion chamber according to the invention.

FIG. 1 shows a combustion chamber 1 according to the invention that is constructed as an annular combustion chamber around a shaft axis 9. The combustion chamber 1 includes a vortex generator 14, a mixing zone 11, and a combustion zone 12. Such an annular combustion chamber is very well suited for operation as a self-igniting combustion chamber 1, wherein the combustion chamber 1 is placed between two turbines not shown in the figures.

A hot gas flow 5 coming from a first turbine (not shown) flows through the vortex generator 14 into the mixing zone 11, is mixed there with a fuel 3, self-ignites in the combustion zone 12, and is then expanded in a second turbine (also not shown). If such a combustion chamber 1 is operated based on self-ignition, the turbine working upstream is only designed for a partial expansion of the hot gases 5, whereby the hot gases 5 then still flow into the vortex generator 14 and the mixing zone 11 of the combustion chamber 1 at a rather high temperature. The temperature of the self-ignition naturally depends on the fuel. An abrupt cross-section increase 13 is located between the mixing zone 11 and the combustion zone 12. The flame front occurs in the plane of the cross-section increase 13.

The mixing zone 11, as shown in FIG. 1, can be constructed as a Venturi channel. Other cross-sections for the mixing zone can be chosen, as long as this promotes the improved acceleration and mixing of fuel 4 and hot gases 5. In the region of the narrowest point, a fuel lance 2 is located that is used to inject fuel 3 and additional support air 4 into the hot gases 5. According to the invention, the fuel lance 2 is set into a sidewall 6 of the mixing zone 11. The fuel 3 and support air 2 therefore are distributed asymmetrically in relation to the cross-section of the mixing zone 11.

One advantage of such a lateral, asymmetrical injection of the fuel 3 is that the fuel lance 2 presents only a slight interference with the flow. The interference with flow is located only on the side wall 6 of the mixing zone 11, and no longer, as in the past, centrally in the main flow. In an advantageous embodiment, the fuel lance 2 is set in the shape of a sphere or ellipsoid extending in the main flow direction of the hot gas 5 into the sidewall 6 of the combustion chamber 1 and projecting into the interior of the mixing zone 11 of the combustion chamber 1.

The reduced contact surface area between the fuel lance 2 and the hot gas flow helps to minimize the required cooling of the fuel lance 2 as well as increase the overall stability of the combustion chamber 1. In practice, this means that the reduced surface of the fuel lance 2 can be easily cooled. An improved seal to prevent leakages is achieved because the breakthrough in the side wall 6, instead of a long hole as known in the past, can be made correspondingly smaller. The shape of the break-through can be, e.g., circular or ellipsoid, which helps to reduce the overall quantity of leakage.

Figure 2:
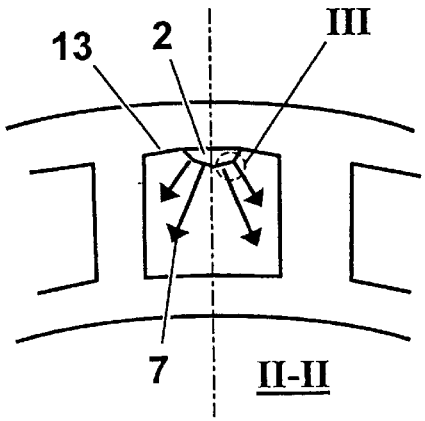
FIG. 2 shows a section taken along line II—II in FIG. 1.
Figure 3:
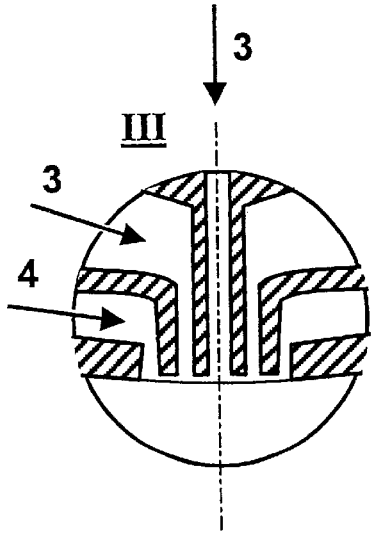
FIG. 3 shows an enlargement of the area III in FIG. 2.

According to an advantageous embodiment of the method according to the invention, the fuel 3, and if desired, support air 4 are injected in different fuel/support air mixture jets 7 into the mixing zone 11 of the combustion chamber 1. The different fuel/support air mixture jets 7 are oriented in different sectors or different target spaces within the mixing zone 11 of the combustion chamber 1. FIG. 2 shows a section taken along line II—II of FIG. 1. The orientation of the jets 7 into different regions of the mixing zone 11 is shown clearly. FIG. 3 shows a more detailed portrayal of section III of FIG. 2. The arrangement of several channels next to each other permits the injection of fuel 3 and support air 4. The support air 4 surrounds the fuel 3 in the shape of a sleeve, whereby the fuel jets are injected as a plain jet into the mixing zone. By choosing different channels, different types of fuel (gaseous/liquid) can be used.

The use of different nozzle geometries is suitable for this purpose. The embodiment of the jets 7 is particularly advantageous because, depending on the load on the combustion chamber, jets 7 can be added or switched off. This means that the jets 7 are individually fed. Overall, the entire operating range can be increased from a minimum to a maximum fuel quantity. This achieves a better behavior at partial loads, which has a positive effect on the behavior with respect to noxious substances, i.e., the formation of CO, NOx, UFHC etc. It is also possible to add or switch off all fuel/support gas mixture jets 7 of a fuel lance 2 together.

The arrangement of the fuel lances 2 according to the invention is also advantageous because follower areas behind the fuel lance 2 in which fuel 3 may collect are practically completely excluded.

The change in cross-section through the mixing zone 11, for example, as a Venturi channel or possibly additionally present built-in elements (radially or circumferentially) within the mixing zone, achieves an increase in velocity and thus improved mixing of hot gas 5 and fuel 3/support gas 4. This is also advantageous in combination with the above-mentioned built-in elements since with the targeted feeding of different sectors through the jets 7 the fuel can be transported with the same pressure into different sectors.

What is claimed is:

1. A method for injecting fuel and support air into a combustion chamber, said method comprising: injecting the fuel into a mixing zone in a hot gas flow using at least one fuel lance; and burning the fuel/air mixture in a combustion zone following the mixing zone in order to produce a waste gas flow, the mixing zone being preceded by a vortex generator, and the combustion chamber being ignited by self-ignition, the fuel and the support air being injected from at least one sidewall of the mixing zone of the combustion chamber into the mixing zone wherein the fuel and support air are injected asymmetrically from the same nozzle in different fuel/support air mixture jets into the mixing zone of the combustion chamber, and the different fuel/support air mixture jets are directed in different directions or different sectors within the mixing zone of the combustion chamber.

2. The method as claimed in claim 1, wherein: fuel/support air mixture jets are added or switched off dependent on the load behavior of the combustion chamber.

3. The method according to claim 1, wherein gaseous or liquid fuel is injected into the combustion chamber in the different fuel/support air mixture jets.

4. The method according to claim 1, wherein the different fuel/support air mixture jets are injected into an annular combustion chamber.

5. The method according to claim 1, wherein the different fuel/support air mixture jets are injected into a mixing zone with a change in the cross-section.

6. The method according to claim 1, wherein the different fuel/support air mixture jets are injected into a venturi-channel as a mixing zone.

* * * * *